US008322459B2

(12) United States Patent
Kuo

(10) Patent No.: US 8,322,459 B2
(45) Date of Patent: Dec. 4, 2012

(54) PNEUMATIC POWER TOOL

(76) Inventor: David Kuo, Tainan (TW)

( * ) Notice: Subject to any disclaimer, the term of this patent is extended or adjusted under 35 U.S.C. 154(b) by 257 days.

(21) Appl. No.: 12/909,942

(22) Filed: Oct. 22, 2010

(65) Prior Publication Data

US 2012/0000685 A1 Jan. 5, 2012

(51) Int. Cl.
*B25F 5/00* (2006.01)

(52) U.S. Cl. ..... 173/178; 173/218

(58) Field of Classification Search ..... 173/178, 173/218

See application file for complete search history.

(56) References Cited

U.S. PATENT DOCUMENTS

| | | | | |
|---|---|---|---|---|
| 3,217,564 | A * | 11/1965 | Smith | 475/270 |
| 3,237,484 | A * | 3/1966 | Smith | 475/270 |
| 4,277,209 | A * | 7/1981 | Benjamin et al. | 408/139 |
| 4,653,338 | A * | 3/1987 | Yeomans | 74/318 |
| 5,201,374 | A * | 4/1993 | Rahm | 173/178 |
| 5,954,457 | A * | 9/1999 | Stock et al. | 408/6 |
| 2012/0000685 | A1 * | 1/2012 | Kuo | 173/218 |

* cited by examiner

*Primary Examiner* — Brian D Nash

(57) ABSTRACT

A pneumatic power tool includes a pneumatic motor mounted in a housing and supplied to pressured air through an air control unit to rotate a drive coupler, a coupling shell member surrounding the drive coupler and having axially opposite actuating and engaging regions, an output spindle having a bearing surface disposed between the drive coupler and the engaging region, and an override clutch unit coupling the drive coupler to the coupling shell member. An override movement of a driven clutch half on the engaging region brings the actuating region to move axially so as to force a latch to an unlatched position such that the air control unit is displaced to a shut-off state.

9 Claims, 7 Drawing Sheets

PNEUMATIC POWER TOOL

BACKGROUND OF THE INVENTION

1. Field of the Invention

This invention relates to a pneumatic power tool, more particularly to a pneumatic power tool with a torque controlled for automatic shut-off.

2. Description of the Related Art

Referring to FIGS. 1 to 3, a conventional power screwdriver 1 is disclosed in U.S. Pat. No. 5,201,374, and includes a pneumatic motor 12 received in a housing 11, a power control 16, and a torque responsive override clutch 2 coupling the motor 12 to an output shaft 17. A power control actuating mechanism includes a push rod 14 which, in an entry state, rests against a transversely movable latch 21 and is released for axial displacement toward a shut-off state at relative rotation between driving and driven halves 24,23 of the clutch 2. The actuating mechanism further includes balls 273 disposed in peripheral pockets in one of the halves 24,23, either of which balls 273 is arranged to cooperate with the latch 21 to shift the latch 21 to an unlatched position to thereby make the power control 16 shut off the power supply to the motor 12 as the clutch 2 overrides at a desired torque level. However, the conventional power screwdriver 1 has a complicated construction with a large number of components and is therefore inconvenient to fabricate.

SUMMARY OF THE INVENTION

An object of the present invention is to provide a pneumatic power tool which has a simple and compact construction.

According to this invention, the pneumatic power tool includes a housing; a pneumatic motor mounted in the housing; an air control unit coupled to the pneumatic motor and displaceable from a shut-off state to an entry state where a pressured air is introduced in the pneumatic motor; a drive coupler drivenly coupled to the pneumatic motor to rotate about an axis, and axially movable relative to the housing between depressed and non-working positions that correspond to the entry and shut-off states, respectively; a latch received in and radially movable in the drive coupler between latched and unlatched positions; a tappet disposed to be axially engaged with the latch when the latch is in the latched position, to move with the drive coupler to the depressed position so as to displace the air control unit to the entry state, and axially disengaged from the latch when the latch is in the unlatched position, to permit axial movement of the tappet so as to displace the air control unit to the shut-off state; and an output spindle having a shank which is disposed in the housing and which extends axially to terminate at a bit-side end exposed out of the housing. The output spindle has a clutch-side end portion including a flared segment which extends outwardly and radially and which has a bearing surface. The bearing surface defines a plurality of ball-engaging areas angularly displaced from one another about the axis.

The pneumatic power tool further includes a coupling shell member which surrounds the drive coupler and which has an inner shell surface including actuating and engaging regions axially opposite to each other, and an override clutch unit. The override clutch unit includes a driving clutch half disposed on an outer surrounding region of the drive coupler, and having a plurality of locating areas which are angularly displaced from one another, a plurality of balls, each disposed in a respective one of the locating areas and to be rollably engaged with a respective one of the ball-engaging areas so as to permit anti-frictional rotation of the drive coupler relative to the output spindle in the non-working position, and a driven clutch half disposed on the engaging region of the inner shell surface of the coupling shell member, and configured to abut the balls against the locating areas. An override movement of the driven clutch half which arises from an increased load mechanically transferred from the bit-side end to the engaging region, brings the actuating region to move axially so as to force the actuated end of the latch to the unlatched position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
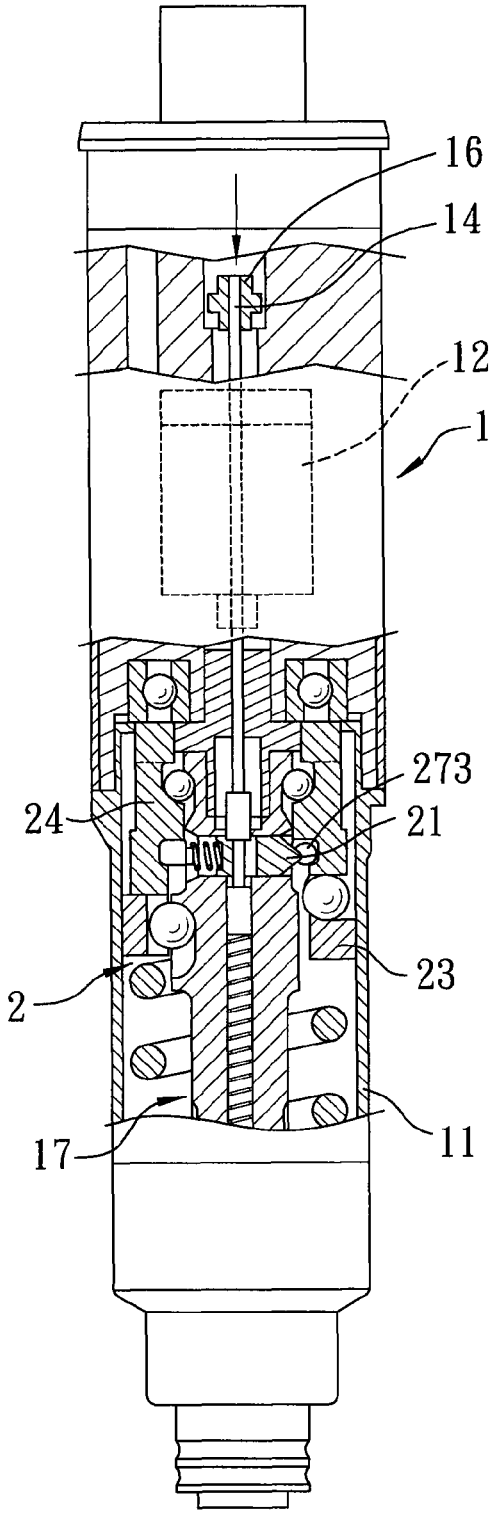
FIG. 1 PRIOR ART
FIG. 1 is a partly sectional view of a conventional power screwdriver disclosed in U.S. Pat. No. 5,201,374.
Figure 2:
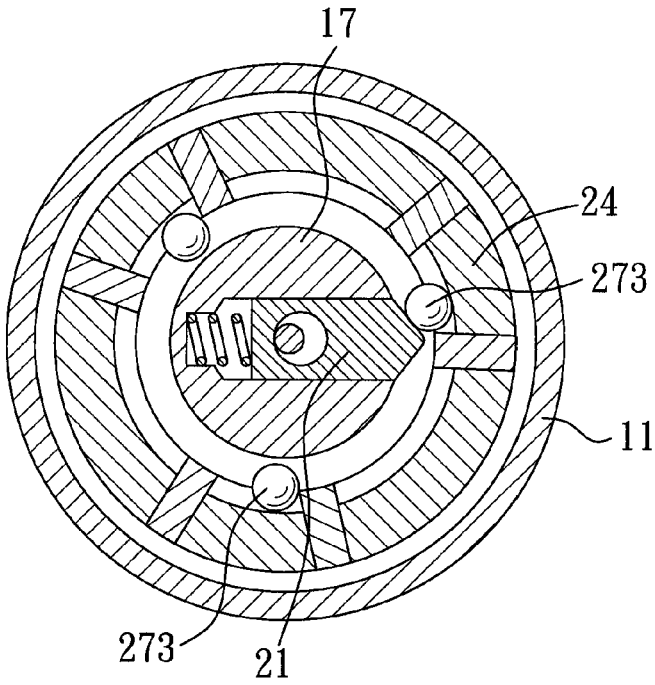
FIG. 2 PRIOR ART
FIG. 2 is a cross-sectional view of the conventional power screwdriver in FIG. 1.
Figure 3:
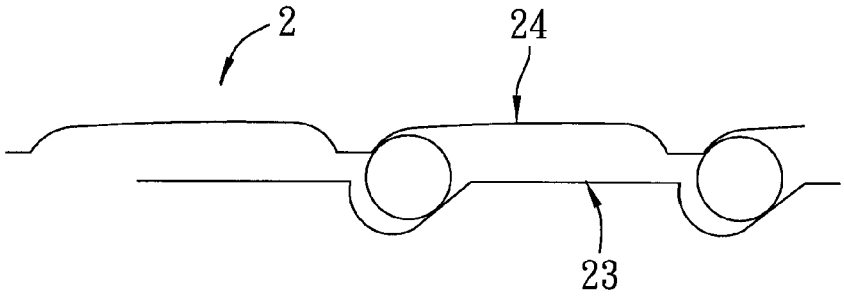
FIG. 3 PRIOR ART
FIG. 3 is a schematic view of a override clutch of the conventional power screwdriver in FIG. 1.
Figure 4:
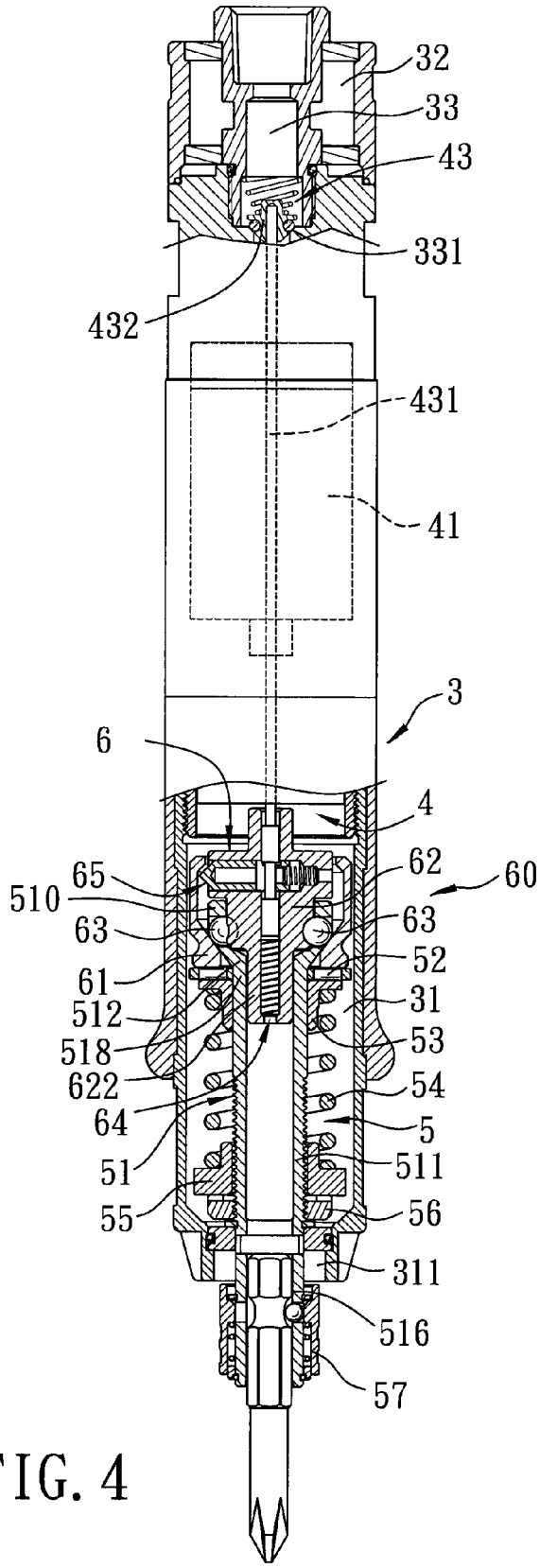
FIG. 4 is a partly sectional view of the preferred embodiment of a pneumatic power tool according to this invention.
Figure 5:
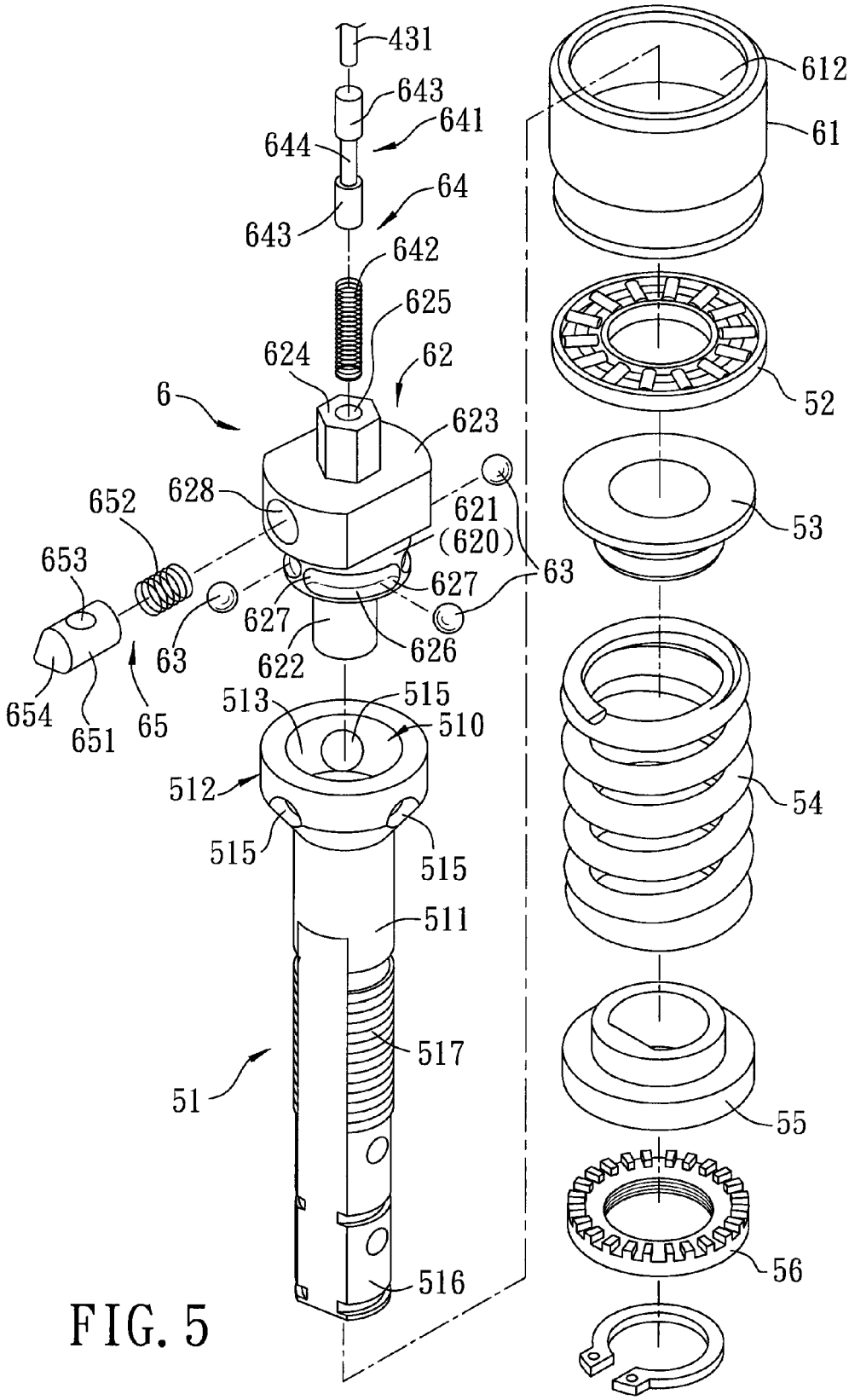
FIG. 5 is an exploded perspective view of a subassembly of the preferred embodiment.
Figure 6:
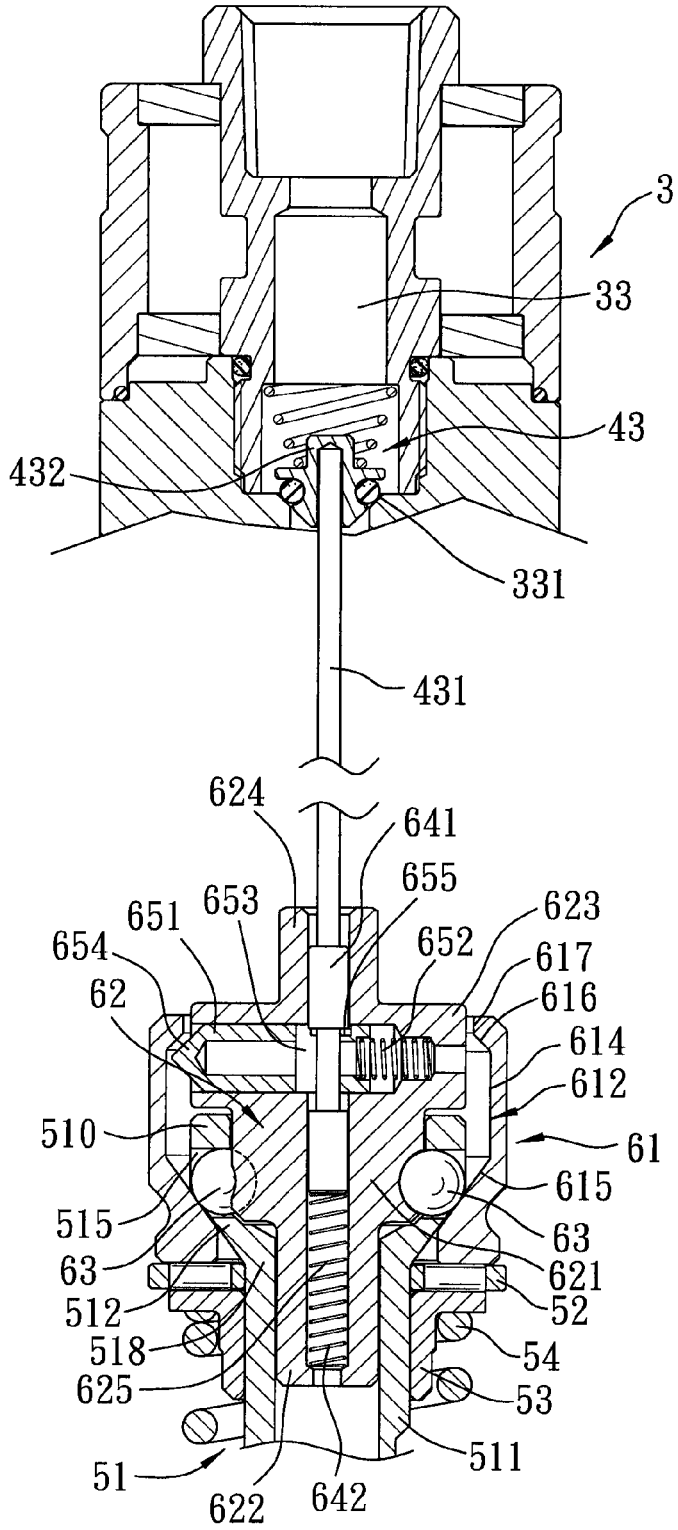
FIG. 6 is a fragmentary sectional view showing the preferred embodiment in an initial state.

Referring to FIGS. 4 to 6, the preferred embodiment of a pneumatic power tool according to the present invention is shown to comprise a housing 3, a pneumatically driving mechanism 4 mounted in an upper compartment 32 of the housing 3, an output mechanism 5 mounted in a lower compartment 31 of the housing 3, and a torque controlling mechanism 6 coupling the drive mechanism 4 to the output mechanism 5. The upper compartment 32 of the housing 3 has a pressured air inlet passage 33 with a valve seat 331, and the lower compartment 31 of the housing 3 has an opened end 311. The pneumatically driving mechanism 4 includes a pneumatic motor 41 in which pressured air is introduced through the pressured air inlet passage 33, and an air control unit 43 which has a valve 432 cooperating with the valve seat 331, and a pushing rod 431 extending downwardly along an axis from the valve 432 such that axial movement of the pushing rod 431 can result in engaging the valve 432 with the valve seat 331 to displace the air control unit 43 to a shut-off state (see FIG. 6), or disengaging the valve 432 from the valve seat 331 to displace the air control unit 43 to an entry state (see FIG. 7). In this embodiment, the pneumatic motor 41 is operable reversibly by means of a control button (not shown) and the introduced pressured air can be discharged from an exhaust passage in a known manner.

The output mechanism 5 includes a tubular output spindle 51 which has a shank 511 extending axially to terminate at a bit-side end 516 that is exposed out of the housing 3 from the opened end 311, and at a clutch-side end portion 512 disposed opposite to the bit-side end 516. The shank 511 has a threaded portion 517 between the bit-side end 516 and the clutch-side end portion 512. The clutch-side end portion 512 has a tubular segment 518 extending axially from the shank 511, and a flared segment 510 which extends outwardly and radially and which has a bearing surface 513. The bearing surface 513 defines a plurality of ball-engaging areas 515 in the form of holes which extend radially and outwardly through the flared segment 510 and which are angularly displaced from one another about the axis. The output mechanism 5 further includes a thrust bearing 52, an upper axial sleeve 53, a load biasing member 54, and a lower axial sleeve 55 sleeved on the shank 511, and a screw nut 56 threadedly engaged with the threaded portion 517. A chuck 57 is provided on the bit-side end 516.

The torque controlling mechanism 6 includes a drive coupler 62 drivenly coupled to the pneumatic motor 41 to rotate about the axis, a coupling shell member 61 surrounding the drive coupler 62, a latch unit 65, a tappet unit 64, and an override clutch unit 60.

The drive coupler 62 is axially movable with the output mechanism 5 relative to the housing 3 between depressed and non-working positions that correspond to the entry and shut-off states, respectively. The drive coupler 62 includes a coupling end 624 coupled with the pneumatic motor 41 so as to be driven to rotate about the axis, a guided end 622 received in the tubular segment 518 of the output spindle 51, an accommodation segment 623 having a radially extending tubular chamber 628, and amounting segment 621 disposed axially opposite to the accommodation segment 623 and having an outer surrounding region 620 that surrounds the axis. Further, the drive coupler 62 has an axial channel 625 communicated with the tubular chamber 628.

The latch unit 65 includes a latch 651 and a spring 652. The latch 651 has an actuated end 654 and an axially extending passage 653, and is received in and movable in the tubular chamber 628 between a latched position where the actuated end 654 is disposed radially and outwardly of the accommodation segment 623, and an unlatched position where the passage 653 is aligned with the axial channel 625. The spring 652 is disposed to bias the latch 651 to the latched position.

The tappet unit 64 is received in the axial channel 625 and includes a tappet 641 configured to be axially movable relative to the drive coupler 62, and a spring 642 disposed to bias the tappet 641 upwardly. The tappet 641 has two large-diameter segments 643 and a small-diameter segment 644 interposed therebetween. The upper large-diameter segment 643 is connected to the pushing rod 431. Thus, when the latch 651 is in the latched position, the upper large-diameter segment 643 of the tappet 641 rests against a shoulder 655 on the latch 651 to move with the drive coupler 62 to the depressed position (FIG. 7) so as to displace the air control unit 43 to the entry state. When the latch 651 is in the unlatched position, the upper large-diameter segment 643 is disengaged from the shoulder 655 to permit downwardly axial movement of the tappet 641 so as to displace the air control unit 43 to the shut-off state (FIG. 8).

The coupling shell member 61 has an inner shell surface 612 including actuating and engaging regions 617,615 axially opposite to each other, and a slope region 616 and a straight region 614 disposed proximate to the actuating and engaging regions 617,615, respectively.

The override clutch unit 60 includes a driving clutch half disposed on the outer surrounding region 620 of the drive coupler 62, a plurality of balls 63 each rollably engaged with a respective one of the ball-engaging areas 515, and a driven clutch half disposed on the engaging region 615 of the coupling shell member 61. The driving clutch half includes a plurality of locating areas 626 angularly displaced from one another. Each locating area 626 is in form of an elongated groove 626 having two smaller-depth pressing ends 627. Each ball 63 is rollably disposed in the elongated groove 626 so as to permit anti-friction rotation of the drive coupler 62 relative to the output spindle 51 in the non-working position. The driven clutch half is in the form of a surrounding inclined surface to radially urge the balls 63 to abut against the corresponding pressing ends 627 of the elongated grooves 626. In this embodiment, the driving clutch half is integrally formed with the drive coupler 62, and the driven clutch half is integrally formed with the coupling shell member 61. Moreover, the load biasing member 54 is disposed to exert an axial bias force to the coupling shell member 61 to make the balls 63 transfer a torque up to a desired magnitude, and is a hitherto known type, description on it is omitted herein.

Figure 7:
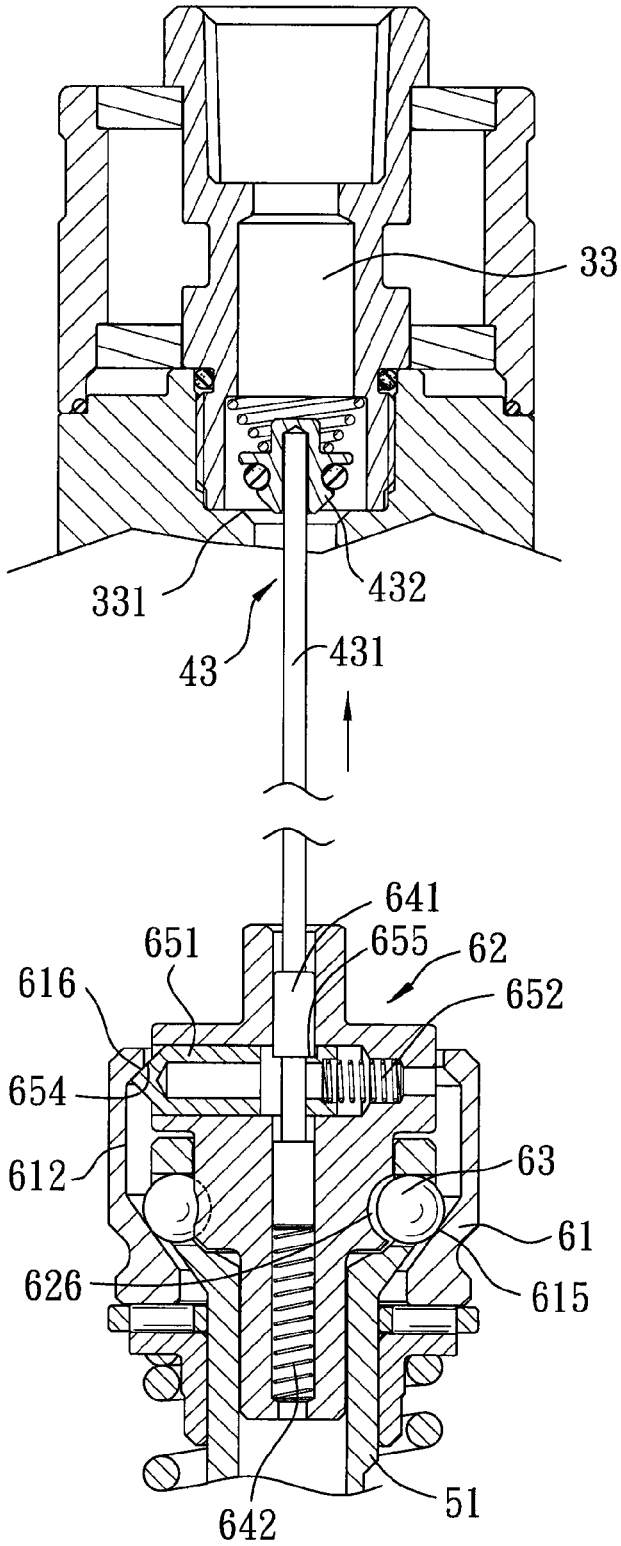
FIG. 7 is a fragmentary sectional view showing the preferred embodiment in a state to approach a preset torque.
Figure 8:
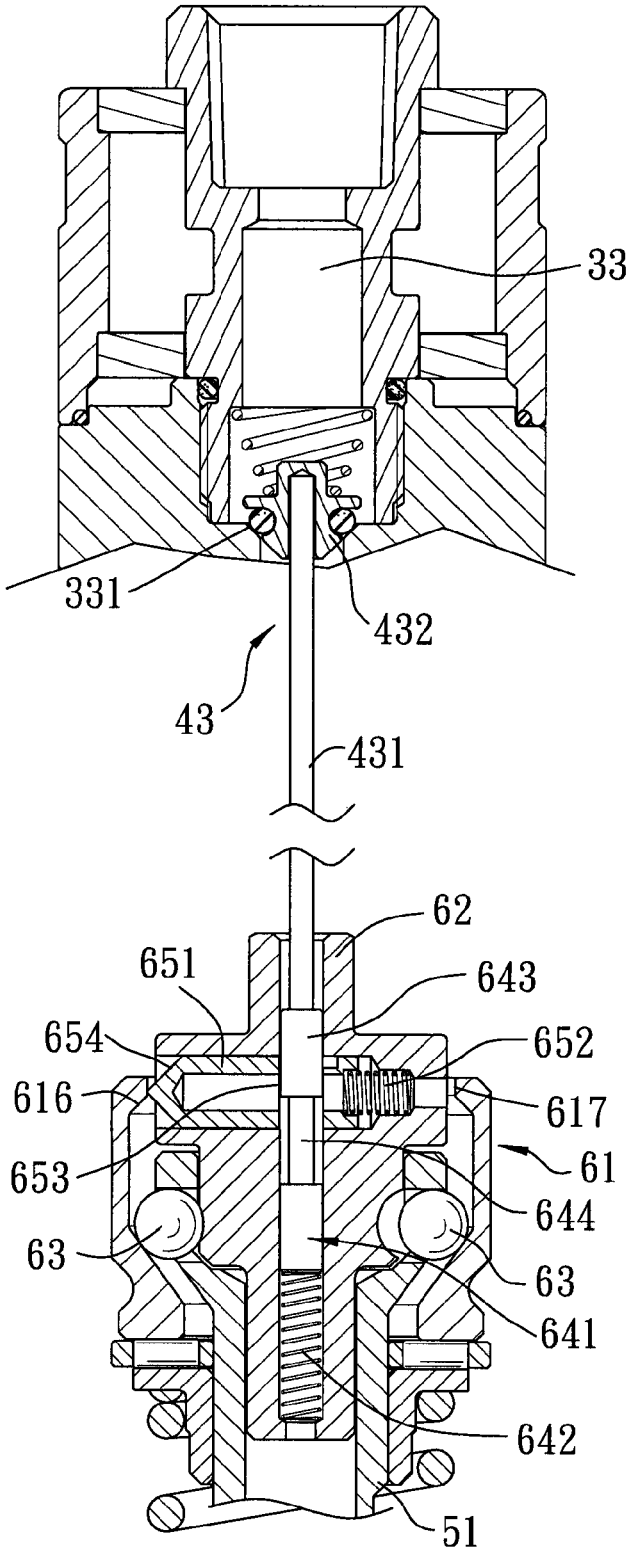
FIG. 8 is a fragmentary sectional view showing the preferred embodiment in an override state.

Referring to FIG. 7, during the process of use, a tool bit mounted on the chuck 57 is pressed on a workpiece to displace the output mechanism 5 and the torque controlling mechanism 6 upwardly to the non-working position against the load biasing member 54 so as to permit introduction of the pressured air into the pneumatic motor 41 for rotating the drive coupler 62. By engagement of each of the balls 63 with the corresponding pressing end 627 and the engaging region 615, the output spindle 51 as well as the coupling shell member 61 is rotated for rotating the workpiece. At this stage, the actuated end 654 is disposed at the slope region 616 of the coupling shell member 61.

Referring to FIGS. 4, 7 and 8, once a load mechanically transferred from the tool bit to the engaging region 615 is increased to exceed the torque transferred from the drive coupler 62, an override movement of the coupling shell member 61 arises to bring the actuating region 617 to move axially so as to force the actuated end 654 of the latch 651 to the unlatched position against the biasing action of the spring 652. At this stage, the passage 653 is aligned with the axial channel 625 such that the tappet 641 and the pushing rod 431 are pushed downwardly by the pressured air to bring the air control unit 43 to the shut-off state.

Thereafter, when the bit-side end 516 of the output spindle 51 abuts against another workpiece to move the coupling shell member 61 upwardly so as to permit the latch 651 to displace back to the latched position, the tappet 641 is moved upwardly by means of the spring 642 to rest on the shoulder 655 so as to return to the initial state shown in FIG. 6.

As mentioned above, the pneumatic power tool according to this invention can have a torque controlled for automatic shut-off for protecting a workpiece to be rotated. Since the driving and driven clutch halves are respectively formed on the drive coupler 62 and the coupling shell member 61 coaxially surrounding the drive coupler 62, the construction of the pneumatic power tool according to this invention is simple and compact, and is easy to fabricate. Moreover, during the override movement, the actuating region 617 is moved synchronously with the engaging region 615 to force the latch 651 to retracted into the tubular channel 628. Thus, the shut-off control of the air control unit 43 is precise and prompt.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A pneumatic power tool comprising:

a housing;

a pneumatic motor mounted in said housing;

an air control unit coupled to said pneumatic motor and displaceable from a shut-off state to an entry state where a pressured air is introduced in said pneumatic motor;

a drive coupler drivenly coupled to said pneumatic motor to rotate about an axis, and axially movable relative to said housing between depressed and non-working positions that correspond to the entry and shut-off states, respectively, said drive coupler having an outer surrounding region surrounding the axis;

a latch which has an actuated end, and which is received in and which is radially movable in said drive coupler between a latched position where said actuated end is disposed radially and outwardly of said drive coupler, and an unlatched position;

a tappet configured to be axially movable relative to said drive coupler such that, when said latch is in the latched position, said tappet is axially engaged with said latch to move with said drive coupler to the depressed position so as to displace said air control unit to the entry state, and such that, when said latch is in the unlatched position, said tappet is axially disengaged from said latch to permit axial movement of said tappet so as to displace said air control unit to the shut-off state;

an output spindle having a shank which is disposed in said housing and which extends axially to terminate at a bit-side end exposed out of said housing, and at a clutch-side end portion disposed opposite to said bit-side end, said clutch-side end portion having a flared segment which extends outwardly and radially and which has an upward bearing surface, said upward bearing surface defining a plurality of ball-engaging areas angularly displaced from one another about the axis;

a coupling shell member which surrounds said outer surrounding region of said drive coupler and which has an inner shell surface including actuating and engaging regions axially opposite to each other; and an override clutch unit including a driving clutch half disposed on said outer surrounding region of said drive coupler, and including a plurality of locating areas which are angularly displaced from one another, a plurality of balls, each disposed in a respective one of said locating areas and to be rollably engaged with a respective one of said ball-engaging areas so as to permit anti-frictional rotation of said drive coupler relative to said output spindle in the non-working position, and a driven clutch half disposed on said engaging region of said inner shell surface of said coupling shell member, and configured to abut said balls against said locating areas such that an override movement of said driven clutch half which arises from an increased load mechanically transferred from said bit-side end to said engaging region, brings said actuating region to move axially so as to force said actuated end of said latch to the unlatched position.

2. The pneumatic power tool according to claim 1, wherein said drive coupler includes an accommodation segment having a tubular chamber which extends radially for receiving said latch, and a mounting segment disposed axially opposite to said accommodation segment and having said outer surrounding region, said drive coupler having an axial channel which is communicated with said tubular chamber and which is disposed for receiving said tappet.

3. The pneumatic power tool according to claim 2, wherein said latch has a passage which extends axially and which is aligned with said axial channel when said latch is in the unlatched position so as to permit the axial movement of said tappet.

4. The pneumatic power tool according to claim 2, wherein said clutch-side end portion of said output spindle has a tubular segment disposed between said flared segment and said bit-side end, said drive coupler further includes a coupling end coupled with said pneumatic motor so as to be driven to rotate about the axis, and a guided end received in said tubular segment.

5. The pneumatic power tool according to claim 1, wherein each of said locating areas is in form of an elongated groove configured to permit a respective one of said balls to be rollable therein so as to facilitate rollable movement of the respective one of said balls in the non-working position.

6. The pneumatic power tool according to claim 5, wherein said driven clutch half is configured to radially urge a respective one of said balls to a corresponding one of said locating areas.

7. The pneumatic power tool according to claim 1, further comprising a load biasing member disposed between said bit-side end and said coupling shell member.

8. The pneumatic power tool according to claim 7, wherein said housing has a pressured air inlet passage through which the pressured air is introduced in said pneumatic motor, and which has a valve seat, said air control unit including a valve cooperating with said valve seat, and a pushing rod interconnecting said valve and said tappet such that axial movement of said tappet results in engaging said valve with said valve seat so as to displace said air control unit to the shut-off state, or disengaging said valve from said valve seat so as to displace said air control unit to the entry state.

9. The pneumatic power tool according to claim 1, wherein said driving clutch half is integrally formed with said drive coupler, and said driven clutch half is integrally formed with said coupling shell member.

* * * * *